United States Patent [19]

Steinkamp et al.

[11] Patent Number: 5,018,934

[45] Date of Patent: May 28, 1991

[54] BACKHOE HYDRAULIC CYLINDER DECELERATOR

[75] Inventors: John O. Steinkamp, Milford; William S. Morrison, Rochester Hills, both of Mich.

[73] Assignee: Ford New Holland, Inc., New Holland, Pa.

[21] Appl. No.: 440,921

[22] Filed: Nov. 22, 1989

[51] Int. Cl.[5] ..... E02F 3/42

[52] U.S. Cl. ..... 414/695.5; 92/85 B

[58] Field of Search ..... 414/694, 695.5; 92/85 B; 91/399

[56] References Cited

U.S. PATENT DOCUMENTS

| | | | |
|---|---|---|---|
| 3,626,812 | 7/1970 | Trick | 92/85 B X |
| 3,630,120 | 12/9171 | Carlson et al. | 414/694 X |
| 3,782,710 | 1/1974 | Selke et al. . | |
| 3,797,366 | 3/1974 | Hanes et al. . | |
| 4,151,784 | 5/1979 | Fussangel . | |
| 4,321,987 | 3/1982 | Dressell, Jr. et al. . | |

*Primary Examiner*—Robert J. Spar

*Assistant Examiner*—Donald W. Underwood

*Attorney, Agent, or Firm*—Larry W. Miller; Frank A. Seemar; Darrell F. Marquette

[57] ABSTRACT

A backhoe pivotally supported from a prime mover is disclosed wherein the hydraulic boom cylinder operably interconnecting the frame of the prime mover and the boom member for operably moving the boom assembly generally vertically relative to the prime mover is provided with a decelerator to slow the flow of hydraulic fluid from the cylinder as the cylinder becomes completely collapsed, corresponding to a placement of a boom assembly into a transport position. The decelerator is formed as a piston extension detachably connected to the piston of the hydraulic cylinder and having an orifice therethrough to permit passage of hydraulic fluid at a slower rate once the piston extension seal has passed the corresponding port. An annular gap between the piston extension and the wall of the boom cylinder permits the flow of hydraulic fluid through the decelerator to reach the exhaust port irrespective of the radial location of the orifice through the piston extension relative to the exhaust port.

10 Claims, 5 Drawing Sheets

10
11
12
13
14
20
21
22
23
25
27
28
30
32
33
34
36
40
41
42
43
45
46
47
48
49
50
52
53
55
56
57
58
G
2

56
40
10
57
14
11
47
59a
49
59b
52
52
50
50
13
13
58
52
12
46
52
G
42
53
53
50
45
41
50

BACKHOE HYDRAULIC CYLINDER DECELERATOR

BACKGROUND OF THE INVENTION

The present invention relates generally to a backhoe forming a part of a machine commonly referred to as a tractor-loader-backhoe and, more particularly, to a decelerator for the hydraulic cylinder operably vertically moving the backhoe boom assembly.

In the operation of backhoes, the complete retraction of the boom cylinder to effect a raising of the boom assembly into an elevated transport position causes a shock loading to the boom cylinder due to the mass of the boom assembly being elevated and a bottoming out of the boom cylinder. To minimize damage to the boom cylinder, to reduce impact stress on the structural components of the machine, and to increase operator comfort by reducing vibration and shocks induced throughout the machine during operation thereof, it has been found desirable to provide a decelerator in the boom cylinder to slow the flow of hydraulic fluid from the boom cylinder as the boom cylinder nears the completely retracted position. By decreasing the flow rate of the hydraulic fluid from the boom cylinder immediately prior to being retracted completely, the speed of the collapsing cylinder is slowed and the shock to the cylinder is reduced.

Known prior art decelerators have typically used a taper on the retraction end of the piston that would restrict the exhaust of hydraulic fluid out of the exhaust port. Because of a need to increase machining tolerances on both the assembly of the barrel of the boom cylinder and of the piston taper comprising the prior art decelerator, known prior art decelerators did would not always be able to function properly. Accordingly, it would be desirable to provide an improved boom cylinder decelerator that would not be dependent upon the maintenance of tight manufacturing tolerances for proper operation.

SUMMARY OF THE INVENTION

It is an object of this invention to overcome the aforementioned disadvantages of the prior art by providing a decelerator with a hydraulic cylinder operable to raise and lower the boom assembly of a backhoe.

It is a feature of this invention that the raising of a backhoe into a transport position will not subject the boom cylinder to significant shock loads.

It is an advantage of this invention that proper operation of the decelerator is not dependent upon the maintenance of manufacturing tolerances.

It is another feature of this invention that proper function of the decelerator is not dependant on the radial location of the orifice relative to the cylinder port.

It is still another object of this invention to provide a decelerator for a hydraulic cylinder in the form of a piston extension having a seal and a reduced diameter orifice so that fluid escaping the cylinder must pass through the orifice once the piston extension seal has moved past the exhaust port.

It is another advantage of this invention that the hydraulic cylinder detent will automatically retain the hydraulic cylinder in a retracted position until the cylinder is pressurized to effect extension without additional operator input.

It is a further object of this invention to provide a decelerator for the boom cylinder of a backhoe mechanism which is durable in construction, inexpensive of manufacture, carefree of maintenance, facile in assemblage, and simple and effective in use.

These and other objects, features, and advantages are accomplished according to the instant invention by providing a backhoe pivotally supported from a prime mover wherein the hydraulic boom cylinder operably interconnecting the frame of the prime mover and the boom member for operably moving the boom assembly generally vertically relative to the prime mover is provided with a decelerator to slow the flow of hydraulic fluid from the cylinder as the cylinder becomes completely collapsed, corresponding to a placement of a boom assembly into a transport position. The decelerator is formed as a piston extension detachably connected to the piston of the hydraulic cylinder and having an orifice therethrough to permit passage of hydraulic fluid at a slower rate once the piston extension seal has passed the corresponding port. An annular gap between the piston extension and the wall of the boom cylinder permits the flow of hydraulic fluid through the decelerator to reach the exhaust port irrespective of the radial location of the orifice through the piston extension relative to the exhaust port.

BRIEF DESCRIPTION OF THE DRAWINGS

The advantages of this invention will become apparent upon consideration of the following detailed disclosure of the invention, especially when taken in conjunction with the accompanying drawings wherein.

DETAILED DESCRIPTION OF THE PREFERRED EMBODIMENT

Figure 1:
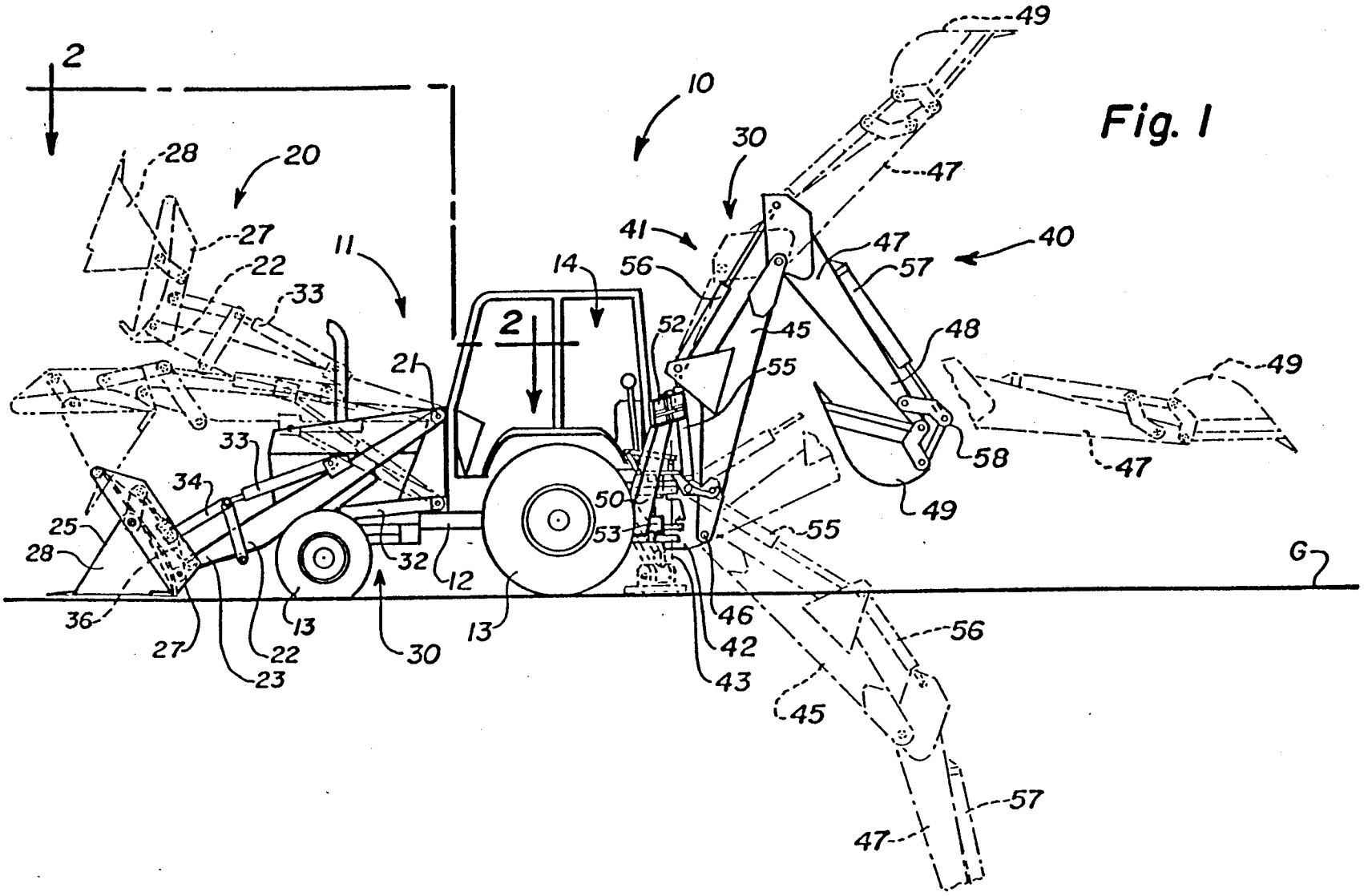
FIG. 1 is a side elevational view of a tractor-loader-backhoe incorporating the principles of the instant invention, the respective movements of the loader mechanism, articulated working tool, outrigger stabilizers, and backhoe mechanism being shown in phantom.

Referring now to the drawings and, particularly, to FIG. 1, a side elevational view of a tractor-loader-backhoe, commonly referred to as a TLB, incorporating the principles of the instant invention can be seen. Any left and right references are used as a matter of convenience and are determined by standing at the rear of the machine, facing the forward end, the direction of travel. The tractor-loader-backhoe 10 includes a prime mover 11 having a frame 12 provided with wheels 13 to permit mobile movement of the prime mover 11 over the ground G. The prime mover 11 is also provided with an operator's station 14 in which various operative controls are conveniently accessible to permit the operator to control the operable functions of the tractor-loader-backhoe 10.

Figure 2:
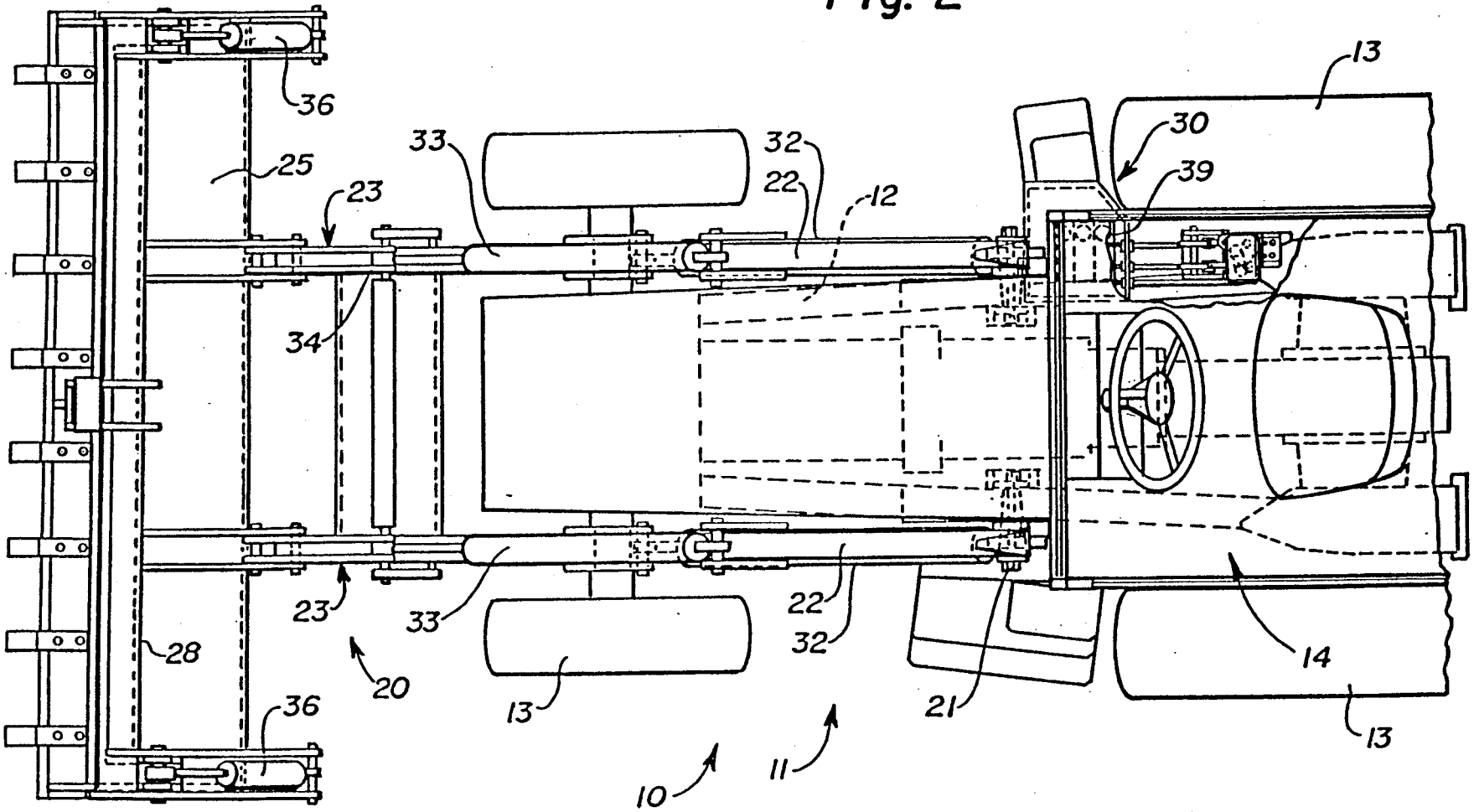
FIG. 2 is an enlarged top elevational view of the forward portion of the tractor-loader-backhoe shown in FIG. 1, corresponding to lines 2—2 of FIG. 1, to show the loader mechanism in greater detail.

As is best seen in FIGS. 1 and 2, the TLB 10 has a loader mechanism 20 mounted forwardly thereof for the handling of material. The loader mechanism 20 includes a pair of fore and aft extending loader arms 22 pivotally connected to the frame 12 for vertical movement, as shown in phantom in FIG. 1, about a generally horizontally extending axis 21, and a working tool 25 pivotally connected at the distal end 23 of the loader arms 22 for pivotal movement relative thereto, as is also shown in phantom in FIG. 1. The working tool 25, shown in FIGS. 1 and 2 as a bucket, can be capable of independent articulated movement, such as shown in the clam shell bucket in phantom in FIG. 1. Such buckets would include at least a base member 27 affixed to the loader arms 22 and a movable member 28 pivotally supported from the base member 27 to be movable relative thereto.

The prime mover 11 is provided with a conventional power source (not shown) including a hydraulic system 30 providing a source of hydraulic fluid under pressure to various hydraulic components carried by tractor-loader-backhoe 10. The hydraulic system 30 includes a pair of hydraulic cylinders 32 interconnecting the frame 12 of the prime mover 11 and the loader arms 22 to power the pivotal movement thereof about the horizontal axis 21. Similarly, a pair of co-acting hydraulic cylinders 33 interconnecting the loader arms 22 and a linkage 34 operably connected to the working tool 25 effects pivotal movement of the working tool 25 relative to the loader arms 22.

For those machines !0 incorporating an articulated working tool 25, the hydraulic system 30 would also include a pair of transversely disposed co-acting hydraulic cylinders 36 interconnecting the base member 27 and the movable member 28 to effect articulation of the movable member 28 relative to the base member 27. Each hydraulic cylinder 32, 33, 36 would be provided with conventional plumbing connections (not shown) to provide hydraulic fluid under pressure thereto through a control valve 39 supported on the frame 12 adjacent the operator's compartment 14 to control the direction of flow of hydraulic fluid through the hydraulic system 30 in a conventional manner.

Figure 3:
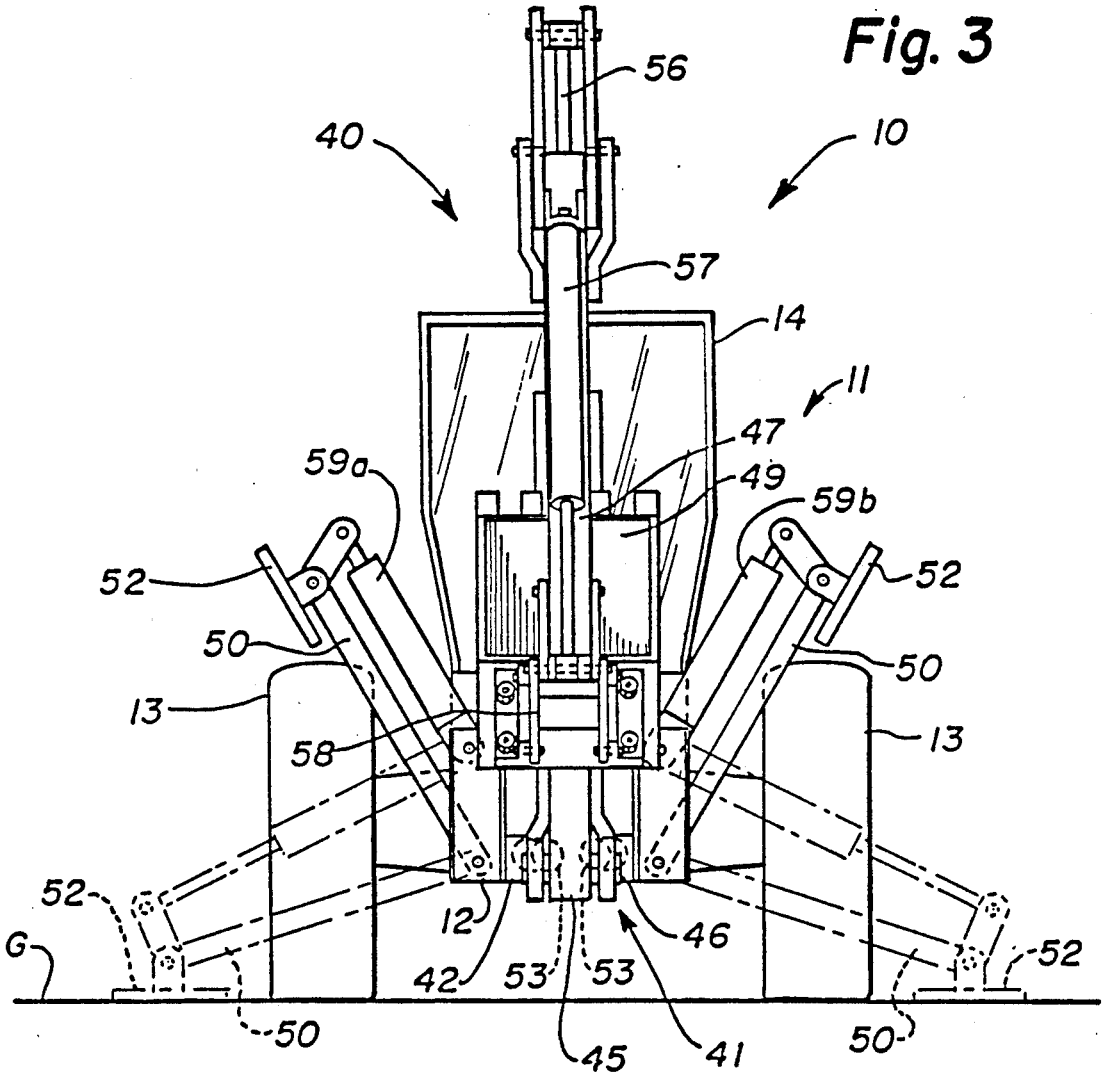
FIG. 3 is a rear elevational view of the tractor-loader-backhoe seen in FIG. 1, depicting the backhoe mechanism mounted thereon in a transport position, the pivotal movement of the outrigger stabilizers being shown in phantom.

Referring now to FIGS. 1 and 3, it can be seen that the tractor-loader-backhoe 10 is also provided with a backhoe mechanism 40 mounted at the rearward end of the prime mover 11 for pivotable operation in a known manner. The backhoe mechanism 40 includes a boom assembly 41 including a mounting member 42 pivotally connected to the frame 12 to permit pivotal movement of the boom assembly 41 about a generally vertically extending axis 43. The boom assembly 41 also includes a boom member 45 pivotally connected to the mounting member 42 for generally vertical movement about a horizontally extending axis 46 and a dipper member 47 pivotally connected to the boom member 45 for articulated movement relative thereto a common vertical plane therewith. The boom assembly 41 also includes a digging bucket 49 pivotally connected to the distal end 48 of the dipper member 47 for articulated movement relative thereto in a conventional manner.

When the backhoe mechanism 40 is being operated, a means for stabilizing the motion of the prime mover 11, i.e., to restrain rolling motion of the wheels 13, is customarily provided. The machine 10 is provided with a pair of laterally extending outrigger stabilizers 50 pivotally connected to the frame 12 of the prime mover 11 for movement between an elevated transport position, shown in solid lines in FIG. 3, and a ground engaging position, shown in phantom in FIG. 3. Each outrigger stabilizer 50 is provided with a ground engaging shoe 52 which can be constructed in a number of configurations to complement the surface of the ground G to be engaged. By sufficient downward pressure of the loader mechanism 20 and the outrigger stabilizers 50, the prime mover 11 can be elevated to the extent that the wheels 13 are not engaged with the ground G during operation of the backhoe mechanism 40.

To power the operation of the backhoe mechanism 40 and the outrigger stabilizers 50, the hydraulic system 30 is also provided with swing cylinders 53 interconnecting the frame 12 of the prime mover 11 and the mounting member 42 to effect pivotal movement thereof in a generally horizontal plane about the vertical axis 43. The hydraulic system 30 also includes a boom cylinder 55 interconnecting the mounting member 42 and the boom member 45 to power the vertical movement of the boom member 45, dipper member 47, and bucket 49 about the horizontal axis 46.

The hydraulic system 30 also includes a dipper cylinder 56 interconnecting the boom member 45 and the dipper member 47, as well as a bucket cylinder 57 interconnecting the dipper member 47 and the bucket 49 through a conventional connecting linkage 58. Each outrigger stabilizer 50 is provided with an individually operable cylinder 59*a*, 59*b* to permit level stabilization of the prime mover 11 on sloping ground, as is conventionally known. Each hydraulic cylinder 53, 55, 56, 57, 59*a*, and 59*b* are independently operable through a conventional control mechanism (not shown) located in the operator's compartment 14.

Customarily, the backhoe mechanism 40 is operable, through appropriate manipulation of the hydraulic system 30, to dig at an elevation lower than the surface of the ground G in which the prime mover 11 is positioned, as shown in phantom in FIG. 1. The backhoe mechanism 40 can be articulated into a compact transport position shown in FIGS. 1 and 3, centrally located relative to the line of travel of the prime mover 11, for transport thereof over the ground G. When the backhoe mechanism 40 is placed into this transport position, the boom cylinder 55 is completely collapsed to a fully retracted position, while the dipper cylinder 56 and the bucket cylinder 57 are extended. In addition, although movements of the machine 10 for short distances over the ground G require only a disengagement of the stabilizers 50 from the ground G, the proper transportation of the machine 10 over the ground G between job sites generally requires a raising of the outrigger stabilizers 50 to the transport position which results in a complete retraction of the associated hydraulic cylinders 59*a*, 59*b*.

Figure 4:
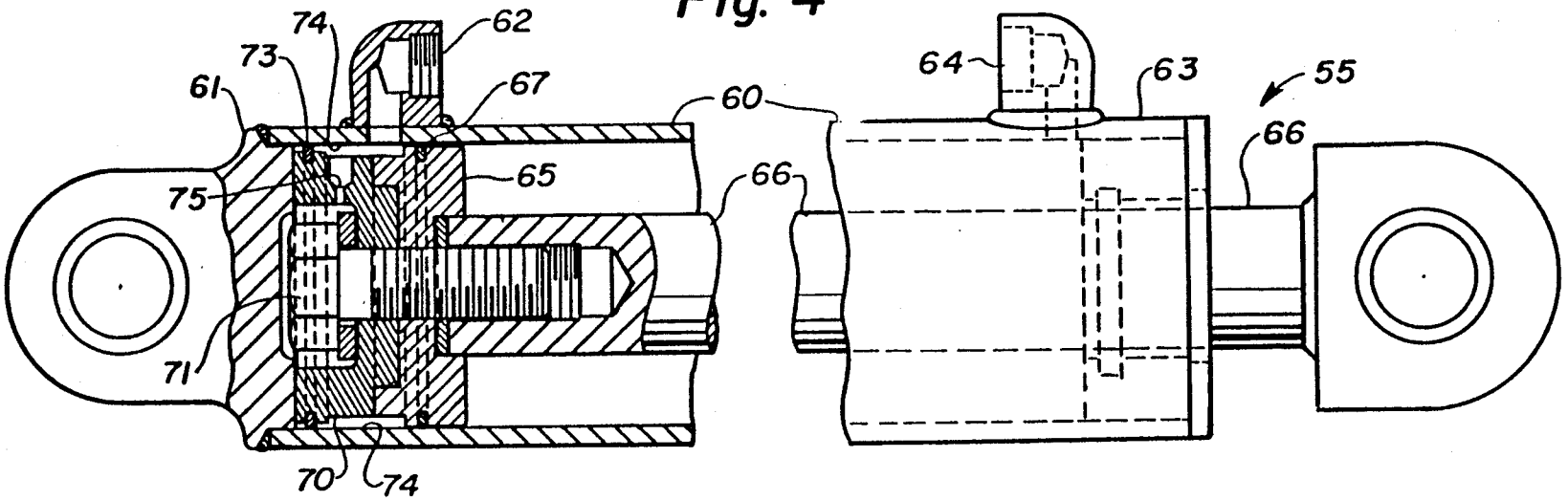
FIG. 4 is an enlarged partial cross-sectional view of the boom cylinder, with the central portion thereof being broken away for purposes of clarity, depicting a cross-sectional view of the piston extension.
Figure 6:
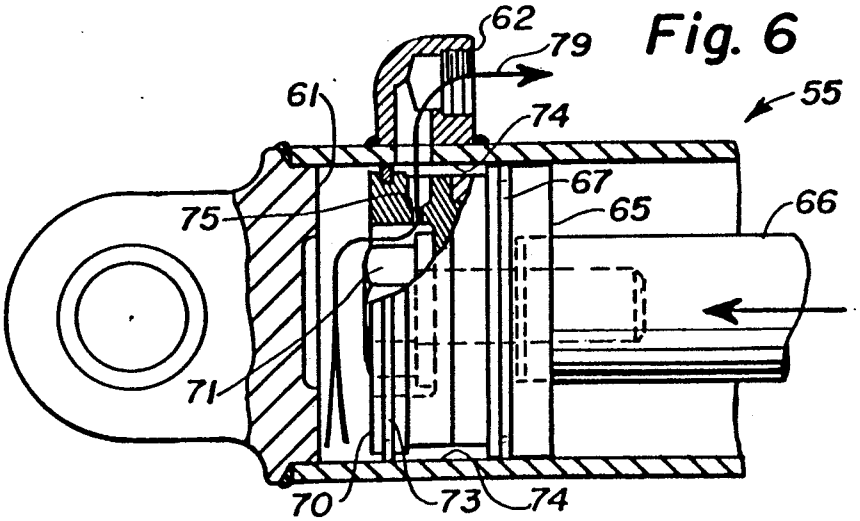
FIG. 6 is a schematic partial cross-sectional view of the retraction end of the boom cylinder after the piston extension seal has moved past the exhaust port of the boom cylinder, requiring the flow of the hydraulic fluid to pass through the piston extension orifice.
Figure 5:
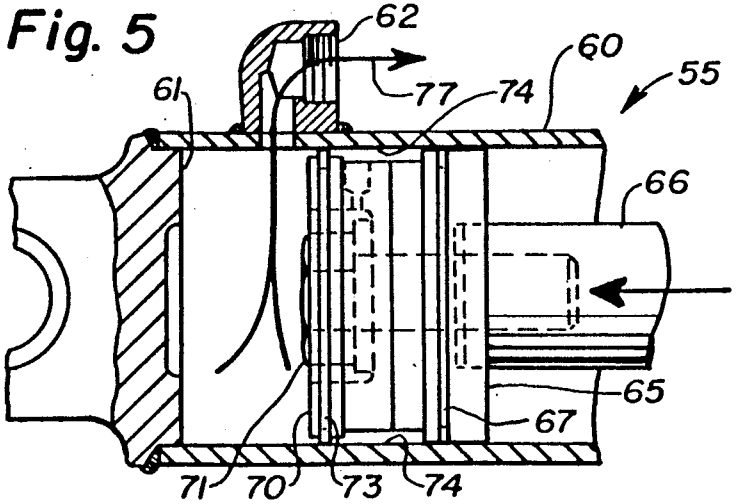
FIG. 5 is a schematic cross-sectional view of the retraction end of the boom cylinder immediately prior to the passage of the piston extension seal past the retraction end exhaust port toward the fully retracted position permitting a full flow of hYdraulic fluid from the retraction end of the cylinder.

Referring now to FIGS. 4–6, the details of the decelerator incorporated into the boom cylinder 55 can best be seen. The boom cylinder 55 includes a barrel 60 having a retraction end 61 and a remote extension end 63, each of which is provided with a port 62, 64, respectively, for communication with the hydraulic system 30 for the supply of hydraulic fluid under pressure thereto. The boom cylinder 55 is also provided with a piston 65 translatable within the barrel 60 from the retraction end 61 to the extension end 63 to effect movement of the rod 66 extending outwardly from the extension end 63. The piston 65 is provided with a seal 67 sweepingly engaging the interior of the barrel 60 to restrict the flow of hydraulic fluid from opposing sides of the piston so that the piston 65 is movable in response to changes in hydraulic pressure on opposite sides thereof.

A piston extension 70 is preferably detachably affixed by a fastener 71 to the retraction end side of the piston 65, although the piston extension 70 may be constructed as an integral part of the piston 65. The piston extension 70 is provided with a seal 73 sweepingly engaging the interior of the barrel 60, similarly to the piston seal 67. The piston extension seal 73 is spaced axially from the piston seal 67 to define an annular gap 74 between the cojoined piston extension 70 and the piston 65 and the interior of the barrel 60, the cojoined piston extension 70 and piston 65 being of smaller diameter than the interior of the barrel 60. The piston extension 70 is also provided with an orifice 75 extending radially into the interior of the piston extension 70 to provide a flow path for hydraulic fluid from the retraction end 61 of the cylinder 55 to the exhaust port 62 once the piston extension seal 73 has swept past the port 62.

As best seen in FIG. 5, the piston extension 70 has translated from the extension end 63 toward the retraction end 61 along the interior of the barrel 60 to the exhaust port 62, permitting the flow of hydraulic fluid from the retraction end 61 through the exhaust port 62 in a normal fashion as demonstrated by the arrow 77. As depicted in FIG. 6, once the seal 73 of the piston extension 70 has moved past the exhaust port 62, except for small insignificant leakages not affecting the performance of the decelerator, the only flow path for hydraulic fluid from the retraction end 61 of the barrel 60 is through the orifice 75 as demonstrated by the arrow 79. Since the diameter of the orifice 75 is considerably reduced with respect to the diameter of the exhaust port 64, the flow rate of hydraulic fluid from the retraction end 61 is considerably slowed once the piston extension seal 73 has moved to the retraction end side of the exhaust port 62.

The slowing of the flow rate of the hydraulic fluid from the retraction end 61 slows the rate of travel of the piston 65 along the interior of the barrel 60, thereby minimizing the shock induced to the retraction end 61 of the cylinder 55 by the mass of the backhoe mechanism 40 when the cylinder reaches a fully retracted position. The exhaust port 62 is located from the retraction end 61 a sufficient distance to permit the piston extension seal 73 to move past the port 62, yet maintain the piston seal 67 on the extension side of the exhaust port 62 when the piston 65 is completely retracted.

Figure 7:
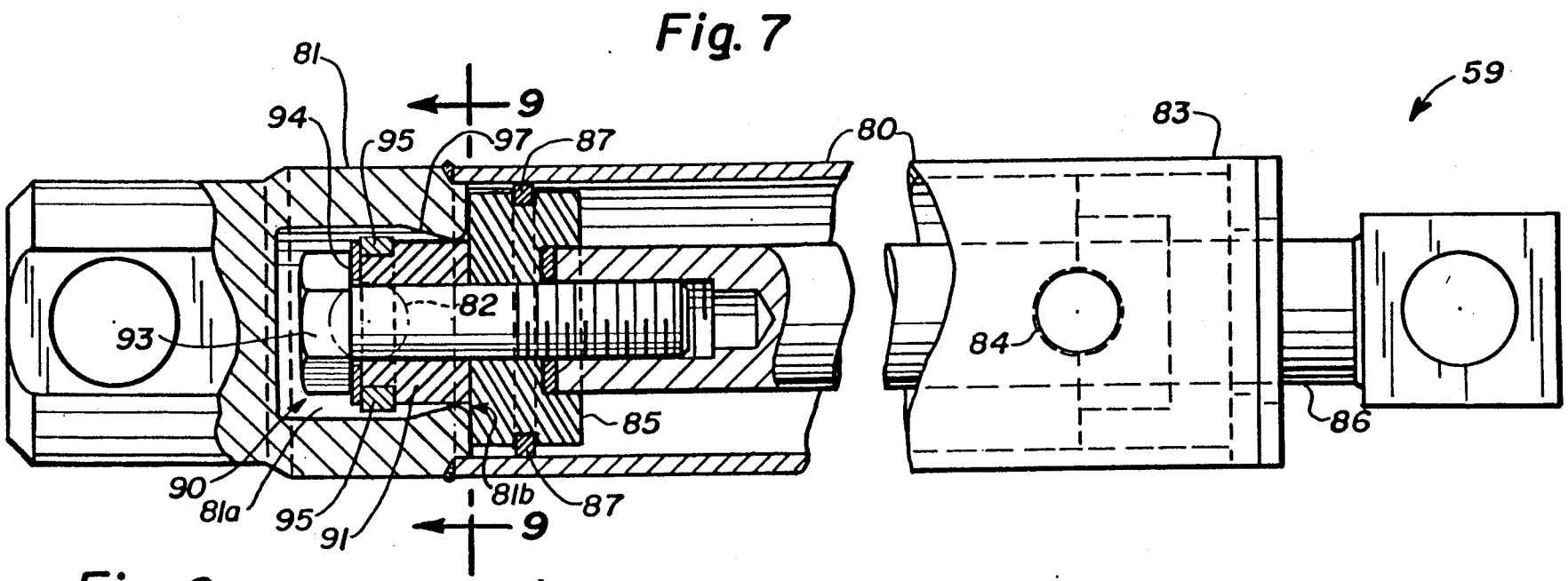
FIG. 7 is an enlarged partial cross-sectional view of the outrigger stabilizer cylinder with the central portion thereof broken away for purposes of clarity, depicting the detent mechanism at the retraction end of the cylinder.
Figure 9:
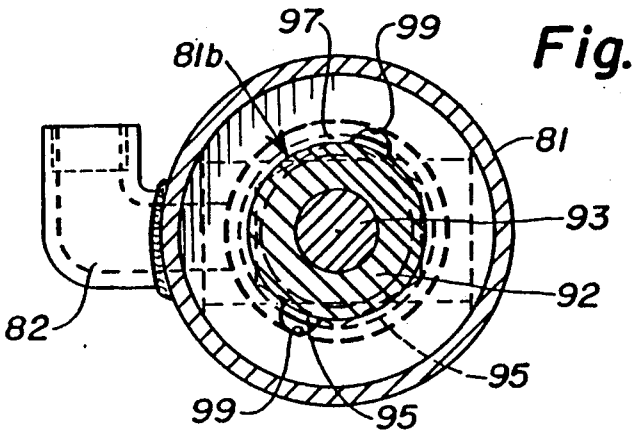
FIG. 9 is a cross-sectional view of the retraction end of the outrigger stabilizer cylinder taken along lines 9—9 of FIG. 7.
Figure 8:
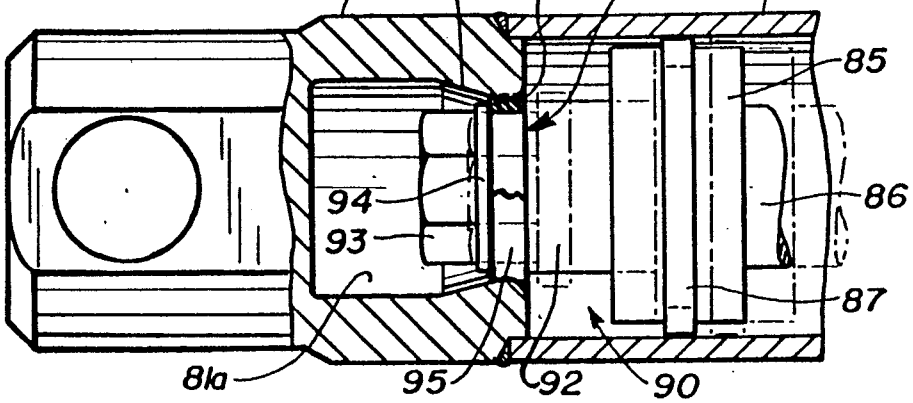
FIG. 8 is a schematic cross-sectional view of the retraction end of the outrigger stabilizer cylinder depicting an engagement of the deformable detent ring with the ramp-like projection with the cylinder approaching the completely retracted position, the position of the piston prior to engaging the projection being shown in phantom.

Referring now to FIGS. 7–9, the details of the outrigger stabilizer cylinders 59*a*, 59*b* can best be seen. As noted with respect to FIGS. 4–6 above, the cylinder 59 includes a barrel 80 having a retraction end 81 and an extension end 83, each of which is provided with an exhaust port 82, 84, respectively, for communication with the hydraulic system 30 for the supply of hydraulic fluid under pressure to the respective end, 81, 83 of the cylinder 59, the exhaust port 82 being shown in phantom because of the breaking away of the barrel 80 to view the cross-section of the cylinder 59. The cylinder 59 also includes a piston 85 translatable along the interior of the barrel 80 in response to differences in hydraulic pressure on opposing sides thereof. The piston 85 is connected to the rod 86 extending outwardly from the extension end 83 of the cylinder 59 for connection thereof with the operative component. The piston 85 is provided with a seal 87 extending circumferentially therearound in sweeping engagement with the interior of the barrel 80 to prevent the flow of hydraulic fluid to opposite sides of the piston 85.

The detent mechanism 90 includes a mounting collar 92 preferably detachably connected to the piston 85 by fastener 93 so as to be translatable therewith, although the mounting collar 92 may be constructed as an integral part of the piston 85. The mounting collar 92 supports a detent ring 95 preferably constructed of polyurethane so as to be deformable under pressure due to engagement thereof with the projection 97. The ring 95 is retained in position by a washer 94 associated with the fastener 93. The mounting collar 92 has a smaller outside diameter than the piston 85 and is receivable within a chamber 81*a* having a smaller inside diameter than the outside diameter of the piston 85. Accordingly, the piston 85 cannot pass into the chamber 81*a*.

A ramp-like projection 97 in the form of a ring-like restriction is located at the mouth 81*b* of the chamber 81*a* and extends inwardly from the internal surface of the chamber 81*a* for positioning in interfering engagement with the detent ring 95 so that the detent ring 95 must deform and slide past the projection 97 for the piston 85 to completely retract within the barrel 80, as shown in FIG. 8 positioned adjacent the chamber 81*a*. The inside diameter of the projection 97 is smaller than the inside diameter of the chamber 81*a* and the outside diameter of the detent ring 95 so that the detent ring 95 must deform to move past the projection 97. The exhaust port 82 is located in flow communication with the chamber 81*a* so that hydraulic fluid under pressure introduced into the chamber 81*a* through the port 82 will be operable to force the detent ring 95 past the projection 97 for extension of the hydraulic cylinder 59.

To prevent a hydraulic lockup of the cylinder 59 when the detent ring 95 engages the circular projection 97 while the piston 85 is moving toward the retraction end 81 of the cylinder 80 due to hydraulic fluid being trapped between the engagement of the detent ring 95 and the projection 97 and the engagement of the piston seal 87 and the wall of the cylinder 80, the detent mechanism 90 must include a relief 99 is provided in the projection 97 to allow a flow of hydraulic fluid past the detent mechanism 90. While the relief 99 is shown as being incorporated into the projection 97, the relief 99 could alternatively be incorporated into the detent ring 95 as a gap in the circumference of the ring 95 which would not seal against the projection 97 when the ring 95 engages therewith. In addition, the relief 99 could be provided in the form of a cross drilled orifice (not shown) that bypasses the projection 97 by exiting on opposite sides thereof.

The force required to deform the detent ring 95 sufficiently to slide past the projection 97 is variable depending upon the material and geometric properties of the detent ring 95, the width of the detent ring 95, and the ramp angle of the projection 97. The holding force, i.e., the force required to deform the detent ring 95 to slide past the projection 97, is designed to be greater than the force exerted on the rod 86 of the cylinder 59 by the weight of the corresponding outrigger stabilizer 50. Accordingly, once the outrigger stabilizers 50 have been placed into a transport position with the outrigger stabilizer cylinders 59*a*, 59*b* being completely retracted, the outriggers 50 will be retained in the transport position until sufficient hydraulic pressure is generated on the retraction end 81 of the cylinders 59*a*, 59*b* to overcome the holding force and move the detent ring 95 past the projection 97, whereupon the cylinders 59*a*, 59*b* will operate as convention hydraulic cylinders.

It will be understood that changes in the details, materials, steps, and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description may be employed in other embodiments without departing from the scope of the invention. Accordingly, the following claims are intended to protect the invention broadly as well as in the specific form shown.

Having thus described the invention, what is claimed is:

1. In a backhoe having a prime mover including a wheeled frame; and an articulated boom assembly pivotally connected to said frame for movement about a generally vertical axis, said boom assembly having a working tool connected to a distal end thereof and being operable with articulated movement to move said working tool toward and away from said generally vertical axis, said boom assembly including a hydraulic cylinder interconnecting said boom assembly and said frame and being selectively operable to move said boom assembly about a generally horizontal axis to effect a raising and lowering of said working tool relative to said frame, said hydraulic cylinder having a barrel defining a chamber therewithin to retain hydraulic fluid under pressure and a piston translatable within said barrel in response to differences in hydraulic pressure on opposing sides of said piston, said piston having a rod extending outwardly therefrom beyond said barrel and a seal engageable with said barrel to divide said chamber into a retraction end and an extension end, said piston seal dividing said piston into a retraction side associated with said retraction end and an extension side associated with said extension end, each said end of said hydraulic cylinder having a port associated therewith for the introduction of hydraulic fluid under pressure to opposing sides of said piston seal, the improvement comprising:

a piston extension detachably affixed to said retraction side of said piston and having a fixed second seal mounted thereon for engagement with said barrel at a distance spaced from said piston seal to define an annular gap therebetween, said piston extension further having an orifice extending radially through said piston extension to bypass said fixed second seal to permit the passage of hydraulic fluid between said retraction end and said annular gap, the diameter of said orifice being significantly smaller than the port associated with said retraction end.

2. The backhoe of claim 1 wherein the port associated with said retraction end is positioned such that said retraction end port is registered with said annular gap when said piston nears a completely retracted position, the passage of hydraulic fluid flowing through said orifice whenever said retraction end port is in register with said annular gap, thereby slowing the speed of movement of said piston when approaching a completely retracted position.

3. The backhoe of claim 2 wherein the movement of said second seal to the extension end side of said retraction end port permits a more rapid introduction of hydraulic fluid to said retraction end of said chamber, thereby increasing the speed of movement of said piston within said barrel.

4. The backhoe of claim 3 wherein the piston extension is a separate member detachably affixed to the retraction side of said piston by a fastener.

5. The backhoe of claim 4 wherein said piston extension has a smaller outside diameter than said piston to define said annular gap between said piston extension and the wall of said cylinder barrel.

6. A hydraulic cylinder operably connectable to a supply of hydraulic fluid under pressure, comprising:

a barrel defining a chamber retaining pressurized hydraulic fluid, said barrel having a retraction end and an extension end and a port at each opposing said end for communication with said source of hydraulic fluid under pressure;

a piston translatable within said barrel in response to changes in hydraulic pressure on opposing sides thereof to effect movement of a rod extending outwardly from said barrel, said piston including a fixed piston seal engageable with said barrel to prevent the passage of hydraulic fluid to opposing sides of said piston; and a piston extension detachably affixed to said retraction side of said piston and having a second fixed seal mounted thereon for engagement with said barrel at a distance spaced from said piston seal to define an annular gap therebetween, said piston extension further having an orifice extending radially through said piston extension to bypass said second fixed seal to permit the passage of hydraulic fluid between said retraction end and said annular gap, the diameter of said orifice being significantly smaller than the port associated with said retraction end.

7. The hydraulic cylinder of claim 6 wherein the port associated with said retraction end is positioned such that said retraction end port is registered with said annular gap when said piston nears a completely retracted position, the passage of hydraulic fluid flowing through said orifice whenever said retraction end port is in register with said annular gap, thereby slowing the speed of movement of said piston when approaching a completely retracted position, the movement of said second seal to the extension end side of said retraction end port permitting a more rapid introduction of hydraulic fluid to said retraction end of said chamber, thereby increasing the speed of movement of said piston within said barrel.

8. The hydraulic cylinder of claim 7 wherein the piston extension is a separate member detachably affixed to the retraction side of said piston by a fastener.

9. The hydraulic cylinder of claim 8 wherein said piston extension has a smaller outside diameter than said piston to define said annular gap between said piston extension and the wall of said cylinder barrel.

10. The hydraulic cylinder of claim 9 wherein the retraction end exhaust port is positioned over said piston extension for direct flow communication with said annular gap and said orifice after said second seal has moved to the retraction end side of said retraction end port.

* * * * *